United States Patent [19]

Smith

[11] Patent Number: 4,744,693

[45] Date of Patent: May 17, 1988

[54] POT HOLE FILLER MATERIAL AND METHOD OF FILLING SAME

[75] Inventor: William C. Smith, Stafford, Tex.

[73] Assignee: CRS Sirrine, Inc., Houston, Tex. ; a part interest

[21] Appl. No.: 908,613

[22] Filed: Sep. 17, 1986

Related U.S. Application Data

[63] Continuation-in-part of Ser. No. 688,615, Jan. 3, 1985, abandoned.

[51] Int. Cl.[4] ..... E01C 21/00

[52] U.S. Cl. ..... 404/77; 404/79; 404/80

[58] Field of Search ..... 404/17, 20, 75, 77, 404/79, 80; 523/172; 427/136

[56] References Cited

U.S. PATENT DOCUMENTS

| | | | |
|---|---|---|---|
| 1,915,814 | 6/1933 | Mason et al. | 404/82 X |
| 2,420,410 | 5/1947 | Blankner | 404/79 |
| 2,934,452 | 4/1960 | Sternberg | 404/75 X |
| 3,008,387 | 11/1961 | Wittenwyler et al. | 404/75 |
| 3,070,557 | 12/1962 | Gessler et al. | 404/17 X |
| 3,070,568 | 12/1962 | Gessler et al. | 404/17 X |
| 3,093,601 | 6/1963 | Gessler et al. | 404/17 X |
| 3,228,900 | 1/1966 | Spellberg et al. | 523/172 |
| 3,230,843 | 1/1966 | Santucci | 427/136 |
| 3,270,632 | 9/1966 | Schultz | 404/77 |
| 3,310,517 | 3/1967 | Corbett et al. | 404/17 X |
| 3,310,619 | 3/1967 | Slosberg | 428/143 |
| 3,336,252 | 8/1967 | Raichle | 523/315 |
| 3,564,985 | 2/1971 | Heller | 404/95 |
| 3,625,120 | 12/1971 | Nagy | 404/107 |
| 3,907,449 | 9/1975 | Bennett et al. | 404/75 |
| 3,965,281 | 6/1976 | Takase et al. | 404/80 X |
| 4,072,435 | 2/1978 | Coho | 404/75 |
| 4,097,172 | 6/1978 | Burkhart | 404/75 |
| 4,107,112 | 8/1978 | Latta, Jr. et al. | 404/76 X |
| 4,109,033 | 8/1978 | Blankenhorn et al. | 404/77 X |
| 4,198,177 | 4/1980 | Ray, Jr. | 404/75 |
| 4,215,949 | 8/1980 | Gabriel, Jr. | 404/95 |
| 4,240,946 | 12/1980 | Hemersam | 524/70 |
| 4,362,586 | 12/1982 | Uffner | 404/75 |
| 4,455,186 | 6/1984 | Koehmstedt | 428/63 |
| 4,630,963 | 12/1986 | Wyman | 404/75 |
| 4,650,820 | 3/1987 | Decroix | 404/75 X |
| 4,680,234 | 7/1987 | Kelch | 428/325 X |

FOREIGN PATENT DOCUMENTS 2134811 2/1973 Fed. Rep. of Germany .

OTHER PUBLICATIONS

Scarpinato, "Thin Polymer Concrete Bridge Deck Overlays," Concrete Construction, pp. 711–715 (Aug. 1984).

"Polymer Concretes Pave New Roads," Chemical Markets, pp. 26–28, (Apr. 1985).

*Primary Examiner*—James A. Leppink
*Assistant Examiner*—Matthew Smith
*Attorney, Agent, or Firm*—Steve Rosenblatt

[57] ABSTRACT

A pot hole filling formulation comprises a polyolefin preferably ethylene acrylic acid in combination with an aggregate preferably gravel particles of one-quarter inch dimension or larger. The polyolefin, preferably in pellet form is mixed with the aggregate and applied to the pot hole. A heat source melts the polyolefin and causes it to flow within the pot hole to fill up the crevices in the pot hole. A second layer of aggregate is applied to the top surface of the fill before the polyolefin hardens to improve the skid resistant qualities of the fill as well as to minimize any deleterious effects of ultraviolet light from the sun.

13 Claims, 1 Drawing Sheet

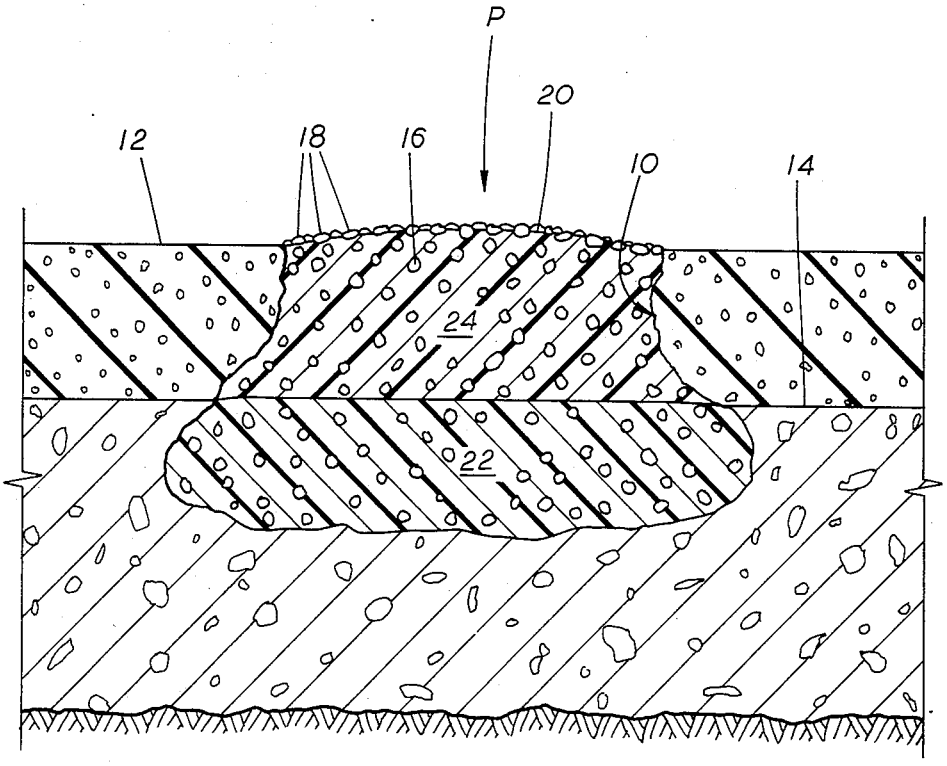
P
20
12
18
16
10
14
24
22

POT HOLE FILLER MATERIAL AND METHOD OF FILLING SAME

This application is a continuation-in-part application of my earlier filed and copending application Ser. No. 688,615, filed Jan. 3, 1985 and entitled "POT HOLE FILLERS", abandoned.

FIELD OF THE INVENTION

The field of the invention relates to methods and materials used to fill pot holes in pavement surfaces.

BACKGROUND OF THE INVENTION

Ever since the advent of hard surfaced roads, the traveling public has been plagued with the problem of pot holes. The causes of these dangerous and property damaging cavities in road surfaces vary somewhat, from the southern to the northern sections of the United States. However, all stem from moisture or water seeping through cracks in pavement down into the soil beneath. This water either freezes, thus creating expansion and forces the substrata upward or washes away the substrata leaving voids beneath the paving surface. Traffic exerts pressure on this weakened area and the surface crumbles thereby creating a pot hole.

The pot hole problem is worsening every year. Between 1960 and 1980 there was an increase of 75 million registered vehicles in the United States. Thirty million of these were trucks with an ever increasing gross weight allowance. These heavy trucks have accounted for 90% of the decrease in road surface longevity.

Pot holes are filled on an average of twice a year, once with a cold patch and again with a hot patch. The hot patch is used when the mean temperature rises above freezing. During this time between fills the weight of heavy traffic dislodges the pot hole fill and causes a perpetual problem.

In northern areas, freezing and contraction of pavement surfaces causes the main problem. In southern areas, heat causes expansion and buckles the pavement surface.

Extensive use is made of asphalt paving as a means for surfacing for general traffic use, both on primary and secondary roads, as well as parking lots and, in some locations, as sidewalks. Asphalt is a dark brown to black cementitious material in which the predominating constituents are bitumens which occur in nature or are obtained in petroleum processing. The Asphalt Institute considers the term "asphalt" to include asphalt cements, asphalt fluxes, asphalt cutbacks, asphalt emulsions, asphalt road oils, roofing and waterproofing asphalts and all other asphalts and asphalt residuums used in the manufacture of asphalts and asphalt specialties. Such widespread use creates and ongoing demand for repair and preventative maintenance. Over prolonged periods of time, for various reasons, the asphalt surface deteriorates or fails or is otherwise damaged and requires repair. Pavements in need of maintenance or repair can exhibit any or all of the following conditions:

"Raveling" is the progressive separation of aggregate particles in a pavement from the surface downward. Usually, the fine aggregate comes off first and leaves little "pock marks" in the pavement surface. As the process continues, larger and larger particles are broken free, and the pavement soon has the rough and jagged appearance typical of surface erosion. Raveling can result from lack of compaction during construction, construction during wet or cold weather, dirty or disintegrating aggregate, poor mix design, or extrinsic damage to the pavement.

"Shrinkage Cracks" are interconnected cracks forming a series of large blocks, usually with sharp corners or angles. They are caused by volume changes in the asphalt mix, in the base, or in the subgrade. "Alligator Cracks" are interconnected cracks forming a series of small blocks resembling an alligator's skin or chicken wire. In most cases, alligator cracking is caused by excessive deflection of the surface over unstable subgrade or lower courses of the pavement. The unstable support usually is the result of saturated granular bases or subgrade. The affected areas in most cases are not large; sometimes, however, they will cover entire sections of a pavement, and when this happens, it usually is due to repeated loadings exceeding the load-carrying capacity of the pavement.

"Upheaval" is the localized upward displacement of a pavement due to swelling of the subgrade or some portion of the pavement structure. In colder climates, upheaval is commonly caused by expansion of ice in the lower courses of the pavement or the subgrade. It may also be caused by the swelling effect of moisture on expansive soils.

"Pot Holes" are bowl-shaped holes of various sizes in the pavement, resulting from localized disintegration of the pavement under traffic. Contributory factors can be improper asphalt mix design, insufficient pavement thickness, or poor drainage. Also, pot holes may simply be the result of neglecting other types of pavement distress.

"Grade Depressions" are localized low areas of limited size which may or may not be accompanied by cracking. They may be caused by traffic heavier than that for which the pavement was designed, by settlement of the lower pavement layers, or by poor construction methods.

The major failure of asphalt surfacing results from moisture penetration of the base material. This penetration of moisture is generally caused and/or accelerated by overloading small units of area through numerous repetitive cycles until the asphalt covering disrupts or separates. Once this occurs, of course, moisture seeps into the base material and not only naturally deteriorates the material, but also may freeze and cause separation of large amounts or quantities of material which are reduced to small particles by continued use of the surface thus eventually causing a hole or depressed area commonly called a "pot hole" as set forth earlier.

In order to prevent or minimize this type of damage from occurring, the asphalt surface is periodically sealed with a seal coat solution that penetrates any separations or disruptions in the asphalt surface thus preventing moisture from entering therein. If, however, the pot hole occurs, one way to prevent additional damage is to trim and excavate the failed area or pot hole, remove any dust, dirt or excess material, reseal the exposed base to preclude any additional moisture from entering therein and replacing the removed asphalt surface with a cold or hot asphalt mix and tamping, compacting, or rolling the hot or cold mix until it achieves the proper density and elevation with respect to the surrounding asphalt surface.

Numerous pavements have a concrete surface rather than asphalt. One proposed method of resurfacing concrete structures has been to employ an epoxy resin such as a reaction product of epichlorohydrin and bisphenol in which polymerization is stopped before a solid product of higher molecular weight is obtained. In that application, it is essential that the epoxy resin employed be liquid in order that the composition may be applied to a damp concrete surface. The mixture further includes a polyamide resin component and a filler such as sand washed free of soluble salts and having particle size of 30 mesh or smaller. A second filler of finer particle size can also optionally be included to give better packing during application of the composition to the road surface. Coloring pigment such as iron oxide, titanium or carbon black can be included as an optional component. Illustrative of such resurfacing technique is U.S. Pat. No. 2,934,452.

Other cold patching techniques have been developed primarily for asphaltic surfaces. Once such technique involves the coating of a cold patch material or mixing such cold patch material with a solution of a thermoplastic polymeric resin. The solvent causes resin penetration into the patching material and the pavement area adjacent the patch. After the solvent volatilizes a thermoplastic resin is provided which purportedly adds strength to the patched area and provides a greater water repellency for the patched area and more firmly secures the patch to the surrounding area. In filling large pot holes, the resin solution is thoroughly mixed with the patch material and compacted in the pot hole such as by rolling or vibratory compaction. The compaction can be accompanied by heat which assists in volatilization of the solvent after the solvent has penetrated the patch and the area surrounding it. In order to obtain the best adhesion, it is preferred in this method to place some of the resin solution on the wall of the cavity prior to inserting the fill material within the cavity. The fill materials employed in this method are typically asphalt and tar. Illustrative of this method is U.S. Pat. No. 4,097,172.

Numerous patents have issued for self-contained vehicles which include hoppers for storing bituminous materials appropriate heating sources and distribution and compaction devices for filling the pot hole and compacting the fill material in the pot hole. Illustrative of such self-contained vehicles are U.S. Pat. Nos. 2,420,410 (includes means for applying heat to the outer periphery of the pot hole to assist the molten material to flow into all the cracks in a liquid condition and to maintain the material in a molten condition for the requisite time to allow full penetration); U.S. Pat. No. 4,072,435 (discloses a vehicle spreader, roller, heater combination including means for mixing asphalt with aggregate); U.S. Pat. No. 3,270,632 (discloses a vehicle including means for heating bumps in a road using a propane heat source in combination with a scraping blade to even up the bumps); U.S. Pat. No. 3,625,120 (discloses a tractor with an asphalt hopper in combination with a sprayer and roller); U.S. Pat. No. 4,215,949 (discloses a vehicle with an asphalt supply hopper, burner, tack oil sprayer and a tamper); U.S. Pat. No. 3,564,985 (discloses a unitary vehicle carrying asphalt and propane heaters for the purposes of pavement repair); U.S. Pat. No. 4,198,177 (illustrates a unitary vehicle for repair of asphalt surfaces including an emulsion tank containing a water soluble, air cured sealer bonding agent and an air compressor driven by the vehicle engine. The vehicle cooling liquid is used for heating the emulsion to a useable temperature while the compressor sprays the emulsion on the surface to be repaired.)

U.S. Pat. No. 4,362,586 discloses a polyamide resin which is used as a primer for highway repairs using asphaltic membranes. The polyamide primer acts as a moisture barrier and promotes bonding to the cementitious substrate. The patent further discloses that the primer extends the low temperature range for adhesive tack. In using the method, a cracking asphalt is filled with a crack filling material. The road substrate surfaces on opposite sides of the crack are then cleaned of loose debris followed by the application of the polyamide primer which is applied in a solvent solution such as anhydrous isopropanol. An asphaltic membrane with an adhesive layer is positioned so that the adhesive layer is in contact with the prime surfaces and spans the filled crack. German Pat. No. 2,134,811 discloses a heatable roadway surface made of an underlayer of bitumen asphalt or concrete which is made by a combination of several steps. The base to be coated is first purified followed by vacuum treatment of the base to remove liquid from the capillaries. An epoxide resin and a hardener under pressure is impregnated into the surface. Heat is applied followed by the imbedding of a heating system in an epoxide mortar which comprises an epoxide resin, hardener, and a filler. Also relating to the field of road construction materials is U.S. Pat. No. 4,240,946 which relates to a preparation of a bituminous binder on the basis of bitumen and polyolefin. The mixture is prepared by a hot mix. This patent also discloses a road construction material using the binder with the inorganic additive material being heated (before being mixed with the binder) to a temperature below the decomposition temperature of the binder. U.S. Pat. No. 3,336,252 relates to a process for the production of molding materials from bitumen and monoolefin polymers. U.S. Pat. No. 3,310,619 discloses the use of methlymethacrylate chips in PVC or PVC copolymer. The chips are encapsulated or permanently bonded without exhibiting excessive thermoplastic flow within a translucent vinyl matrix. U.S. Pat. No. 4,455,186 discloses a self-contained exothermic applicator and process wherein the reactants react exothermically when electrically ignited. The heat liberated by the reaction plasticizes a thermoplastic resin or cures a thermosetting resin to bond together two closely spaced objects.

SUMMARY OF THE INVENTION

A pot hole filling method comprises placing ethylene-unsaturated carboxylic acid copolymer in the pot hole at ambient temperature, placing aggregate in the pot hole, heating the mixture of copolymer and aggregate with an infrared heat source until the copolymer is melted, and removing the heat source.

A pot hole filling formulation comprises a polyolefin, preferably a copolymer of ethylene and an $\alpha,\beta$-ethylenically unsaturated carboxylic acid, in combination with an aggregate, preferably gravel particles of one-quarter inch dimension or larger. The polyolefin, preferably in pellet form is mixed with the aggregate and applied to the pot hole. A heat source melts the polyolefin and causes it to flow within the pot hole to fill up the crevices in the pot hole. A second layer of aggregate and/or carbon black is applied to the top surface of the fill before the polyolefin hardens to improve the skid resistant qualities of the fill as well as to minimize any deleterious effects of ultraviolet light from the sun.

BRIEF DESCRIPTION OF THE DRAWING

The drawing illustrates a sectional view of a pot hole extending below the base of a finished roadway and illustrating the filler material in place within the pot hole.

DETAILED DESCRIPTION OF THE PREFERRED EMBODIMENT

The pot hole filling material P is used to fill the pot hole 10. Pot hole 10 extends downwardly from the roadway surface 12 and sometimes may go deeper than the supporting base 14 for the finished pavement 12.

In contrast to other methods which involve using a combination of an asphaltic material with a resin, the pot hole filling material P is preferably formulated from a polyolefin in combination with aggregate 16. "Aggregate" is used in the context of rock or gravel particles or other materials exhibiting similar physical properties. Broadly, any solid thermoplastic polyolefin is contemplated as suitable in the present invention. The polyolefin used should have the desirable feature of adhesion, dimensional stability and compressive strength. The desired compressive strength is in the range of 3000–4000 pounds per square inch which approximates the compressive strength of the pavement adjacent the pot hole.

In a preferred embodiment, the polyolefin is a copolymer or ethylene and an $\alpha$, $\beta$-ethylenically unsaturated carboxylic acid. The copolymers of ethylene and carboxylic acids have the desirable features of adhesion, dimensional stability and compressive strength. These copolymers are characterized by random inclusion of carboxyl groups along the backbone and side chains of the polymer. The carboxyl functionality of the resulting copolymer also contributes to its improved toughness. The carboxyl groups on adjacent chains can hydrogen bond together. This produces exceptional internal toughness and allows low molecular weight (high melt index) or low viscoscity polymers to have excellent physical properties.

The carboxyl functionality of the polymer also contributes to its excellent adhesion. The carboxyl groups improve the wetting characteristic of the polymer and allow it to chemically interact with and attach to molecules on the substrate surface. The high acid functionality of the copolymer contributes not only to the adhesion qualities described but also to foster improved bond strengths. The preferred formulation can have a range of approximately 12 to 35% by weight carboxylic acid.

An exemplary ethylene-carboxylic acid copolymer commercially available from the Dow Chemical Company under the trademark PRIMACOR is an ethylene-acrylic acid copolymer containing 20% acrylic acid and having a melt index (dg/min, ASTM D-1238, condition E, 190° C., 2.16 Kg) of 500, a Vicat softening point (degrees Fahrenheit) of 111 and a Ring & Ball softening point (degrees Fahrenheit) of 212. Depending on the formulation used, the melt index can vary in a range of 10 to 10,000 preferably about 300 to 2600, with the density varying between 0.953 and 0.960 grams per cc. The viscosity range for the formulations envisioned (Brookfield, Thermosel at 350° F.), varies in the range of 6,900 to 51,000 cps.

The ethylene-acrylic acid copolymer offers improved adhesive strength (over most substrates) than that of polyamide and polyester resins.

Another desirable feature of ethylene acrylic acid copolymer is that the copolymer has excellent optical clarity and is clear in appearance and produces a clear, highly glossy scuff resistant hot melt coating.

While the pot hole filling material is described herinafter with reference to the preferred ethylene-acrylic acid copolymer ("EAA"), it is to be understood that any suitable polyolefin may be used and that the ethylene copolymer may be ethylene copolymerized with any $\alpha$, $\beta$-ethylenically unsaturated carboxylic acids, such as, for example, acrylic acid, methacrylic acid, ethacrylic acid, crotonic acid, vinyl acetic acid, maleic acid, fumaric acid and the like. Further, the ethylene copolymer may be ionically cross-linked by polyvalent metal cations, and may also contain relatively minor amounts of other monomers known to be copolymerizable with ethylene and unsaturated carboxylic acids.

The preparation of the filling material P consists of employing the EAA, as described above, in a granular or pellet form. The EAA is mixed with a gravel aggregate 16 commonly known as pea gravel for example. Depending on the pot hole size, larger particle size aggregate can be used for large holes such as those exceeding eighteen inches in diameter, for example. The preferred particle size for the aggregate is approximately one-quarter inch essentially for smaller pot holes such as those that are less than eighteen inches in diameter for example. The aggregate is mixed with the EAA in a preferred ratio of approximately 65% by volume aggregate to 35% by volume EAA. The two components can be premixed in a hopper before application to the pot hole 10 or can be mixed as they are applied to the pot hole 10 from separate sources. The ratio of the aggregate to EAA can be varied depending on the pot hole size, the desired physical properties of the filling material P and other economic considerations.

The aggregate is beneficial in that the density of the EAA is increased and as a result a higher compressive strength for the filling material 10 can be achieved. It is desirable to obtain compressive strengths in the preferred range of 3000–4000 PSI which is close to the strength of the adjoining road surface. Additionally, the use of aggregate decreases the consumption of EAA resulting in economic savings.

Handling of the material is greatly simplified in that granular materials are dealt with rather than hot molten materials as in some of the known methods used in the past.

When the desired mixture of EAA and aggregate is placed in the pot hole 10, a heat source preferably infrared (not shown) is applied to melt the EAA. The melting of the EAA results in a flow of the material into the crevices of the pot hole 10. Since the EAA is clear when heated, it is fairly simple to observe that all the EAA has melted and filled out all the crevices in the pot hole 10. After the EAA has melted, the aggregate is suspended and encapsulated within the EAA to increase its compressive strength. As shown in the figure, the combination of the EAA and the aggregate 16 is added to the pot hole 10 in a manner to extend above the surface 12 of the roadway. The reason this "crown" of material is applied to extend beyond the roadway surface 12 is that upon melting the fluid in the interstitial voids is displaced resulting in settlement of the fill material P. Therefore, to achieve a close to flat finished surface formed by the pot hole filler material P within the pot hole 10, the material is placed in the pot hole 10 with a crown.

As the heat source is applied, and the EAA is melted, some downward migration of the aggregate 16 can result within the pot hole 10. In the preferred embodiment it is desirable to have a layer of aggregate 18 extending through the top surface 20 of filler material P. In order to accomplish this, additional aggregate is added to the pot hole filler material while the EAA is still in a melted condition. The result is that the vehicle tires maintain better traction with the filling material P as a result of the partially imbedded aggregate 18 extending through its top surface 20. The aggregate also gives the filling material P the appearance of the similar to an adjacent concrete roadway. Furthermore, the top layer of aggregate serves to disperse, to some extent, ultraviolet rays from the sun which tend to, over time, change the properties of certain plastics, such as polyethylene, for example. If the pot hole 10 is in an asphalt roadway, a top layer of carbon black can be applied to the filling material P while the EAA is still in a melted condition s o that the appearance of the finished patch can blend in with the color of the asphalt roadway. The use of carbon black further increases the traction available for vehicle tires contacting the filling material P and disperses ultraviolet sunlight.

In some situations such as that shown in the figure, the pot hole may extend into the road base 14. In that situation, the mixture of EAA and aggregate can be initially applied approximately level (but with a slight "crown") with the base 14 in the manner described above. This step seals the base against moisture which could seep into the patch above and may dislodge it due to expansion in freezing weather. Heat is then added and the initial layer 22 is allowed to melt, spread into the crevices of the base and set up. In a subsequent step, the EAA and aggregate mixture at ambient temperature is applied over the previously hardened layer of the identical mixture. Heat is again applied so that the second layer 24 is melted. The result is that the second layer 24 adheres to the first layer 22 as well as the wall of the pot hole 10.

The pot hole filler material and its method of application offers distinct advantages over previously used pot hole filling methods and materials. The filler material P of the present invention is dimensionally stable over a wide variety of temperatures and humidities in the range of −50 to 250° F. The filler material P is impervious to moisture and road salt and can be easily pigmented with materials such as carbon black to match the original color of the adjacent pavement. Additionally, sand or aggregate can be spread over the topmost layer of the fill material P each of which acts to increase traction of the filling material P.

Since the EAA is handled in pellet form and either premixed with aggregate or mixed in the pot hole 10 with the aggregate, pot hole filling equipment need not be bulky and complex as equipment previously in use. Since asphalt is not used, heating systems such as propane heaters are not necessary for over the road equipment. An electrical source is necessary with the present invention to provide infrared heat which is the preferred method of heating. Other heating methods can be employed without departing from the spirit of the invention.

Since no melting occurs until the polymer is placed in the pot hole 10, maintenance and upkeep on equipment is reduced as compared to porable equipment involving storage or either asphalt or plastics in a melted form. The EAA and aggregate can be correctly premixed, and the mixture can be applied to the pot hole by gravity without the need of any other dispensing equipment.

Since the filling material P melts in the pot hole 10, rollers and other vibratory tampers are not necessary to insure that the material spreads into all the crevices of the pot hole 10. It is simply necessary to sufficiently melt the EAA within the pot hole 10 to insure that the melted polymer sufficiently fills all the crevices of the pot hole 10.

Another advantage of handling the mixture of aggregate and EAA in the manner previously described is that pot holes can be filled all year around in all kinds of weather. Additionally, the inner surface of the pot hole 10 does not need to be prepared in any special way. No adhesive bonding material is needed to be sprayed or brushed on the pot hole walls or hot mixed with asphalt materials prior to application in the hole.

The method of the present invention is not only easier to use from a materials handling point of view but yields improved results over other methods that preheat the filler material before placing it in the pot hole. For example, in systems that use combinations of a bituminous material and an epoxy binder, the binder must either be hand coated on the inner surfaces of the pot hole or must be intermixed with the bituminous fill material. Since the mixture is preheated, it beings to cool as soon as it is placed in the pot hole. Thus, except for the top surface which may be steam rolled, there is no assurance that the solvent carrying the resin has properly penetrated all the crevices in the pot hole and vaporized leaving the resin deposited in the crevices and sealably securing the bituminous material therein.

Use of the preferred ethylene acrylic acid yields advantages over other materials which could be used to fill pot holes. For example, polypropylene is less desirable than EAA in that it is expensive and brittle when it hardens. Combinations of low density polyethylene 0.915–0.922 grams per cc) and medium density polyethylene 0.922–0.928 grams per cc) can be used as a pot hole filling material. However, polyethylene does not have the desirable adhesive qualities of EAA. Using polyethylene may still require a coating of the interior surfaces of the pot hole with an adhesive bonding agent such as EAA before the polyethylene is applied to the pot hole.

Another desirable feature of using the combination of EAA and aggregate to its uniform hardness which prevents chipping away of the filler material P at its extremities which eventually allows the entire pot hole filler P to be dislodged from the pot hole 10.

The foregoing disclosure and description of the invention are illustrative and explanatory thereof, and various changes in the size, shape and materials, as well as in the details of the illustrated construction may be made without departing from the spirit of the invention.

I claim:

1. A method for filling a pot hole comprising:

placing an ethylene-unsaturated carboxylic acid copolymer wherein the carboxylic acid is selected from the group consisting of acrylic acid, methacrylic acid, ethacrylic acid, crotonic acid, vinyl acetic acid, maleic acid and fumaric acid and wherein the carboxylic acid comprises 12 to 35 weight percent of the copolymer into the pot hole at ambient temperature;

placing aggregate in the pot hole;

heating the mixture of copolymer and aggregate with an infrared heat source until the copolymer is melted; and removing the heat source.

2. The method of claim 1, wherein said copolymer is ethylene-acrylic acid copolymer.

3. The method of claim 1 wherein:

the aggregate and copolymer are premixed before placement in the pot hole.

4. The method of claim 3 wherein:

the aggregate and copolymer are premixed before placement in the pot hole.

5. The method of claim 1 further including the step of:

adding more aggregate to the top surface of the copolymer aggregate mixture, while the copolymer is still in a melted state, such that aggregate extends through said top surface.

6. The method of claim 3 further including the step of:

adding more aggregate to the top surface of the copolymer aggregate mixture, while the copolymer is still in a melted state, such that aggregate extends through said top surface.

7. The method of claim 6 wherein the aggregate is at least one-quarter inch in its smallest dimension.

8. The method of claim 1 further including the step of:

adding a top layer of carbon black to the copolymer aggregate mixture.

9. The method of claim 2 further including the step of:

adding a top layer of carbon black to the copolymer aggregate mixture.

10. A method for filling a pot hole extending into the base of a roadway comprising the steps of:

patching the base by the steps of:

placing an ethylene-unsaturated carboxylic copolymer wherein the carboxylic acid is selected from the group consisting of acrylic acid, methacrylic acid, ethacrylic acid, crotonic acid, vinyl acetic acid, maleic acid and fumaric acid and wherein the carboxylic acid comprises 12 to 35 weight percent of the copolymer into the pot hole at ambient temperature;

placing aggregate into the pot hole;

heating the mixture of copolymer and aggregate, which forms a base layer, with an infrared heat source until the copolymer is melted, the mixture having a top surface approximately even to slightly higher than, the remainder of said base;

removing the heat source; and filling the remainder of the pot hole with a top layer by the steps of:

placing copolymer into the pot hole at ambient temperature;

placing aggregate in the pot hole;

heating the mixture of copolymer and aggregate with an infrared heat source until the copolymer is melted; and removing the heat source.

11. The method of claim 10 wherein said copolymer is ethylene-acrylic acid copolymer.

12. The method of claim 11 further comprising the step of:

adding more aggregate to the top surface of the top layer, while the copolymer is still in a melted state, such that aggregate extends through said top surface.

13. The method of claim 12 further including the step of:

adding a layer of carbon black to the top surface of said top layer.

* * * * *